United States Patent [19]

Hubble, III et al.

[11] 4,110,811

[45] Aug. 29, 1978

[54] SUPPORT STRUCTURE FOR A CORONA GENERATING DEVICE

[75] Inventors: Fred F. Hubble, III, Rochester; John B. Tasseff, II, Webster, both of N.Y.

[73] Assignee: Xerox Corporation, Stamford, Conn.

[21] Appl. No.: 802,165

[22] Filed: May 31, 1977

[51] Int. Cl.[2] ..... H05F 3/00; H01T 19/00

[52] U.S. Cl. ..... 361/225; 355/3 CH; 250/324; 361/426

[58] Field of Search ..... 361/214, 220, 225, 417, 361/419, 420, 426; 355/3 CH; 250/324, 325, 326

[56] References Cited

U.S. PATENT DOCUMENTS 3,578,970 5/1971 Michaud et al. ..... 355/3 CH

OTHER PUBLICATIONS

*IBM Tech. Disc. Bull.,* vol. 17, No. 9, Feb. 1975, pp. 2687–2688.

*Primary Examiner*—Gerald Goldberg

[57] ABSTRACT

A corona generating device including a coronode in the form of a wire supported between insulating end block assemblies. Each assembly is constructed of mating half-sections which jointly define a substantially closed and insulated cavity lined with a conductive insert. The insert on the high voltage side of the coronode serves to couple electrically the high voltage terminal to the coronode via a first conductive bead carried by the coronode. The coronode is held taut by means of a loaded compression spring carried within the insert on the half-section removed from the high voltage supply, the spring bearing against the conductive insert on one end and against a second conductive bead carried by the other end of the coronode.

32 Claims, 5 Drawing Figures

SUPPORT STRUCTURE FOR A CORONA GENERATING DEVICE

BACKGROUND OF THE INVENTION

This invention relates to electrostatography. More particularly, this invention relates to corona generating devices for applying electrostatic charge onto a suitable surface.

In the electrostatographic process, an electrostatographic plate comprising a photoconductive insulating material on a conductive backing is given a uniform electric charge over its surface and is then exposed to the subject matter to be reproduced usually by conventional projection techniques. This exposure discharges the plate areas in accordance with the radiation intensity which reaches them and thereby creates an electrostatic latent image on or in the plate coating which may then be developed into visible form by applying a developer material, e.g., a powder, to the plate using any one of a number of development techniques generally known and used in the art. The developer material electrostatically clings to the plate in a visual pattern corresponding to the electrostatic image. Thereafter the developed image is usually transferred from the plate to a support material such as paper to which it may be fixed by any suitable means thereby forming a permanent print.

Instead of being developed by means of a powder, the electrostatic latent image may also be developed by using liquid development techniques also well known in the art.

The charging of the electrostatographic plate in preparation for the exposure step can be accomplished by means of a corona generating device whereby electrostatic charge is applied to the electrostatographic plate to raise it to a potential of approximately 500 to 600 volts. One form of corona generating device for this purpose is disclosed in U.S. Pat. No. 2,777,957 wherein a plurality of parallel wires are connected in series to a high voltage source and are supported in a conductive shield that is arranged in closely spaced relation to the surface to be charged. When the wires are energized, corona is generated along the surface of the wires and ions are caused to be deposited on the adjacent photoconductive surface. Suitable means are usually provided to effect relative movement of the surface to be charged and the corona generating device. Such a device may have a single corona wire.

One problem associated with corona generating devices is the possible breakdown of either the surfaces or the air surrounding or coming in contact with the applied high voltage in areas other than the desired corona discharge area. For example, any sharp edges or corners on conductive members of the device tend to generate sparks to adjacent surfaces or corona. This problem is lessened by insulating all electrically conductive components of the corona device and it is an object of the present design to provide such an arrangement.

It is also important that the coronode which is generally in the form of one or more fine wires stretched between mountings at opposite ends of the device be maintained in taut condition since slackness and kinks in the coronode wires will result in non-uniformity of the charge applied to the electrostatographic plate. In order to ensure that the coronode is maintained in sufficiently taut condition it has heretofore been proposed to connect the coronode wires to at least one of the end mountings by means of a compression spring. This has the desirable feature of enabling the wires to be mounted in the device under tension while reducing the possibility of the wires, which are extremely fine (generally of the order of 0.004 inch thick), being stretched beyond its elastic limit during assembly and it is an object of this invention to provide a resilient mounting for a corona generating device in which this disadvantage is alleviated.

It is also desirable in corona generating devices to provide an arrangement for easily replacing a deteriorated corona electrode with a new one. Since this replacement usually takes place at a commercial site of a machine by a service technician, ease of replacement and adjustment in a minimum amount of time is essential.

SUMMARY OF THE INVENTION

The above noted objects are accomplished, according to the invention by a corona generating device including a coronode in the form of a wire supported between insulating end block assemblies. Each assembly is constructed of mating half-sections which jointly define a substantially closed and insulated cavity lined with a conductive insert. The insert on the high voltage side of the coronode serves to couple electrically the high voltage terminal to the coronode via a first conductive bead carried by the coronode. The coronode is held taut by means of loaded compression spring carried within the insert removed from the high voltage supply, the spring bearing against the conductive insert on one end and against a second conductive bead carried by the coronode.

BRIEF DESCRIPTION OF THE DRAWINGS

In order that the invention may be more readily understood, reference will now be made to the accompanying drawings, in which.

DESCRIPTION OF THE PREFERRED EMBODIMENT

Figure 1:
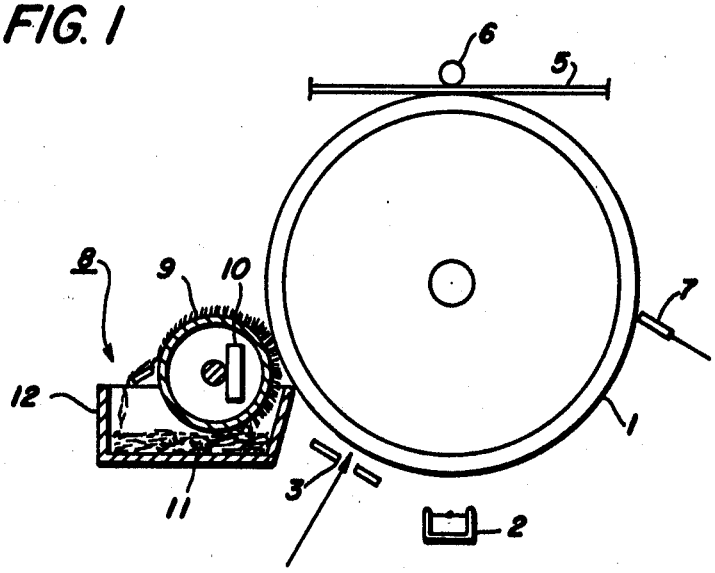
FIG. 1 is a schematic cross-section illustrating the operation of one embodiment of electrostatographic reproduction machine incorporating a corona generating device of this invention.
Figure 2:
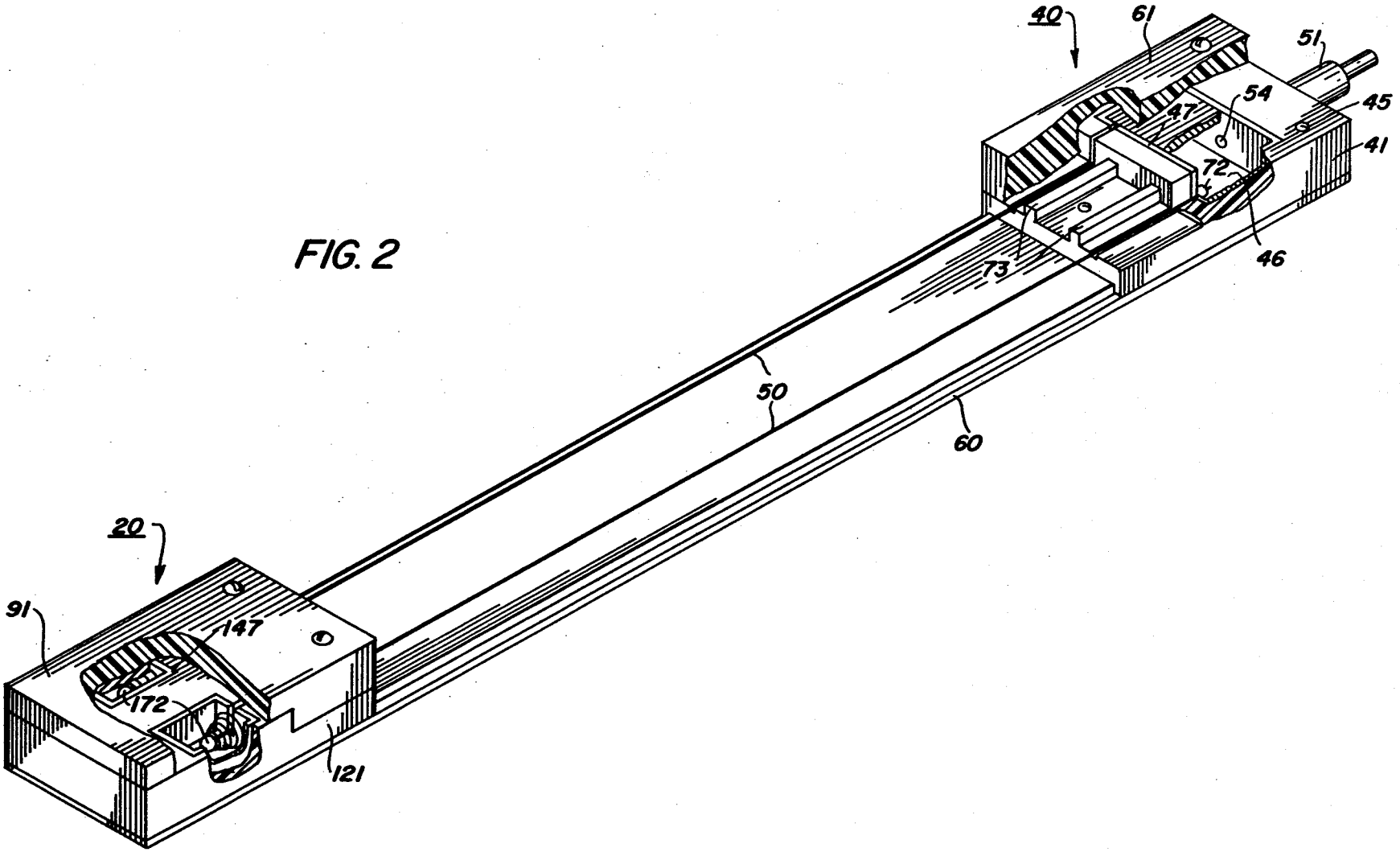
FIG. 2 is a perspective view of one embodiment of corona generating device according to the invention partially broken away for clarity.
Figure 3:
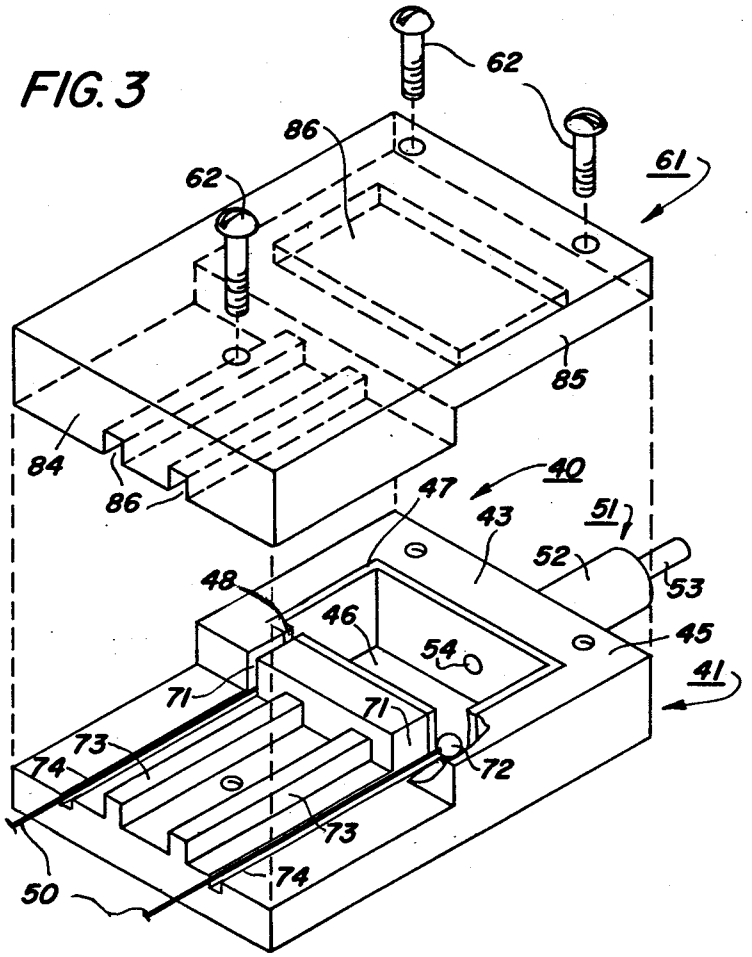
FIG. 3 is an exploded view of one end of the structure or embodiment shown in FIG. 2 showing the details of mounting assembly on the high voltage supply side of the coronode.

Referring to the drawings, the general operation of an electrostatographic machine as illustrated will first be described with reference to FIG. 1. A moving photoconductive plate, in this instance having an endless surface constituting the periphery of a drum 1, is first uniformly charged at a charging station 2 by a corona generating device of this invention and the surface then exposed at an exposure station 3 to a light pattern of the image sought to be reproduced thereby to discharge the charge in the area where light strikes the plate surface. The undischarged areas of the surface thus forms an electrostatic charge pattern in conformity with the configuration of the original image pattern.

The electrostatic latent image is then developed into visible form by the development system 8 of the magnetic brush type which is well known in the art. Subsequent to the development operation the now visible image is transferred from the plate to a sheet of final support material 5, such as paper or the like, thereby to form a permanent print, at a transfer station in accordance with the present invention schematically illustrated at 6. The paper or the like is fed to the transfer station by means (not shown) programmed to deliver the paper in synchronism with the arrival of the developed image.

Following transfer, residual developer remaining on the plate surface is removed by a cleaning blade 7 and collected for subsequent disposal. The plate is then further discharged or erased to a residual voltage prior to a further electrostatographic cycle.

The development system 8 of the illustrated embodiment employs a magnetic brush applicator including a non-magnetic sleeve 9 which rotates about a stationary magnet 10. The magnet serves to create a field which in conjunction with the sleeve moves ferromagnetic developer powder 11 from a storage sump 12 into contact with the plate.

Other development systems are well known in the art and may be utilized with equal success in such reproduction machines.

It is to be understood, as noted hereinbefore, that any kinds or slackness of the wire coronode in the charging device 2 will lead to non-uniform charging of the electrostatographic plate. Slackness also results in non-uniform spacing of the wire from the plate surface and increases the chances of vibration being set up in the wire while it is operating. In order to alleviate the problem of non-uniform charging due to these causes, an arrangement is provided to maintain a constant tension on the wire coronode.

Referring now to FIGS. 2–5, the illustrated embodiment of the corona device according to the invention comprises a coronode 50 supported between insulating end block assemblies 20 and 40. The assemblies 20 and 40 are held a fixed distance apart by means of a rigid insulating support plate 60 (FIG. 2) to which the assemblies may be fastened by conventional means such as insulating screws (not shown). The end block assemblies 20 and 40 are extruded of a high dielectric strength insulator such as polyvinylchloride or nylon. The assembly 40 permits connecton to a high voltage supply for application of a corona generating potential to the coronode 50 as described in greater detail hereinafter. The assembly 40 comprises two approximate half-sections 41 and 61 which are held together in mating relationship by means of three screws 62 or other similar fastening devices. If the screws 62 are made of a conductive material, they are located far enough from any of the other conductive parts (and high voltage applied thereto) of the assembly so as not to provide a potential corona forming surface. Alternatively, the screws may be made of a suitable dielectric, such as nylon.

The lower half-section 41 is formed with a thick walled segment 43 and a thin walled segment 44 which give the section 41 the overall two stepped appearance, the upper step being associated with the thick walled segment 43, and the lower step being associated with the thin walled segment 44.

The thick walled segment 43 is characterized by a generally planar land 45 which forms the outer and uppermost periphery of a central cavity 46, the cavity having a generally rectangular shape when viewed in plan and open at the top. The cavity extends from the level of the land 45 to a level somewhat greater than half the depth of the segment 43. A suitable shaped conductive insert 47 is fitted into the cavity 46 and is provided with a pair of coronode holding slots 48 in the innermost wall and a top or internally threaded hole in the opposed outermost wall. The insert 47 couples the high voltage from a suitable power supply (not shown) via a terminal 51 of the coronode 50. For this purpose the terminal consists of an outer insulative sleeve 52 and an inner conductor 53, the sleeve covering only a portion of the conductor—approximately midway of its length.

The conductor 53 is threaded on one end and passes through a hole in the outermost wall of the section 41 into threaded engagement with the aforementioned internally threaded top in the far wall of the insert. The diameter of the hole in the section 41 through which the conductor 53 passes is selected to be only slightly greater than the diameter of the conductor 53 so that when inserted, the shoulders of the outer sleeve 52 abut the outer wall of the section 41 to limit inward movement of the terminal 51 and hold it in the position shown best in FIG. 5. The outer sleeve may be formed integrally with the end block half-section 41. The insert 47 may take a variety of shapes in line with its function of coupling high voltage from the terminal 51 to the coronodes 50 and while a box-like or rectangular construction open on the top and bottom is illustrated, several other shapes would function acceptably.

The slots 48 in the insert 47 are arranged adjacent similarly shaped slots 71 in the thick walled section 53. The aligned slot pairs define a channel through which one end of the coronodes 50 pass. The coronodes are provided with beaded conductors 72 on the ends thereof, the diameters of the beads exceeding the width of the slots 48 so that, as tension is placed on the opposite end of the coronode the beads 72 abut the interior wall of the wall of the insert 47 and thereby complete a conductive path back to the terminal 51 through the insert 47.

The thin walled segment 44 is provided with upstanding bosses 73 running parallel to the coronode 50 which interfit into complementary shaped recesses in the half-section 61 to facilitate assembly and provide self alignment. A pair of passageways 74 are provided in the segment 44 through which the coronodes pass, the passageways extending from the edge of the segment 44, through the entire length of the segment 44. Each passageway 44 and slots 71 and 48 combine to provide a conduit for the coronodes 50.

The upper half-section 61 of the assembly 40 is shaped to complement or mate with the above described lower half-section 41. For this purpose, it comprises a thin-walled segment 85 and a thick-walled segment 84, the segment 84 overlying and complementing the segment 44 and the segment 85 overlying and complementing the segment 45. The thick-walled segment has recesses 86 which mate with the bosses 73 on the segment 44. The thin walled segment 85 carries a conductive plate 86 which is positioned to form the top wall of the cavity 46 in the lower half-section by snuggly fitting into the top portion of the insert. The insert 47 and member 86, when the half-sections are joined jointly, define a semi-closed conductor lined enclosure for inhibiting corona on the beads and limiting upward movement of the bead.

The end block assembly 20, located remote from the high voltage terminal 51, is comprised of an upper half-section 91 which is generally analogous to the upper half-section 61 previously described and will be therefore described only briefly. The section 91 comprises a thick walled segment 92 and a thin walled segment 93 forming a two stepped member shaped to mate or interfit with corresponding formation the lower section 121. For this purpose, it includes a pair of recesses 110 which mate with upstanding bosses on the lower half-section and a pair of conductive members 111 serve to substantially close the conductor lined cavities in the lower half-section 121. Threaded openings are provided to accept dielectric screws 122 which hold the sections 91 and 121 together.

The lower half-section 121 is formed with a thick walled segment 143 and a thin walled segment 144 which also give the section 121 an overall two stepped appearance, the upper step being associated with the thick walled segment 143, and the lower step being associated with the thin walled segment 144.

The thick walled segment 143 is characterized by a generally planar land 145 which has formed therein a pair of cavities 146, the cavities having a generally rectangular shape when viewed in plan. The cavities extend from the level of the land 145 to a level somewhat greater than half the depth of the segment 143. A suitably shaped conductive insert 147 is fitted into each cavity 146 and is provided with a slot 149. The insert 147 serves to anchor two coronode ends and provide a corona suppressing enclosure at which to terminate the high voltage. The insert 147 may take a variety of shapes in line with the functions noted above and while a box-like or rectangular construction open on the top and bottom is illustrated, several other shapes would function acceptably.

The slots 149 in the insert 147 is arranged adjacent similarly shaped slots 171 in the thick walled section 143. The aligned slot pairs define a channel through which the end of the coronode 50 farthest removed from the high voltage supply passes. The coronodes are provided with beaded conductors 172 on the ends thereof.

The thin walled segment 144 is provided with upstanding bosses 173 running parallel to the coronodes 50 which interfit into the complementary shaped recesses 110 in the half-section 93, as described above. These bosses facilitate assembly and provide self alignment in a manner similar to the bosses 73 on the section 41. A pair of passageways 174 are provided in the segment 144 through which the coronodes ends pass, the passageways extending from the edge of and through the entire length of the segment 144. Each passageway 174 joins with pair of slots 171 and 149 to jointly form a conduit for a pair of coronode ends.

The ends of the coronode remote from the high voltage supply also have pressed thereon beaded conductors 172 or alternatively may be knotted or crimped to provide similar enlarged end portions.

Figure 4:
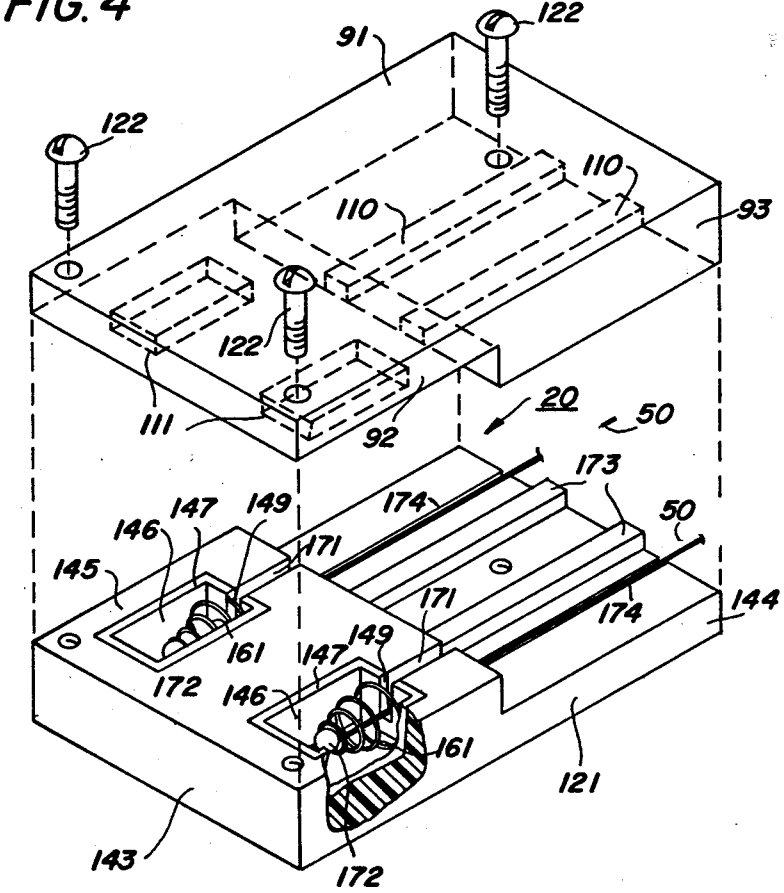
FIG. 4 is an exploded view similar to FIG. 3 of the opposite end of the embodiment shown in FIG. 2.

A pair of compressible resilient means, compression springs 161, are provided to urge the ends of the coronodes 50 in the direction of the adjacent end of the device, i.e., outwardly. To provide tension the ends of the coronode are threaded inside the springs 161 during the assembly of the device and the springs 161 are located in the insert 147 as shown in FIG. 4. It is noted that the compression springs 161 are tapered from one end to the other, the broadest end being located to abut the insert 147 adjacent the slot 149 and the narrow end thereof being in abutment with the bead 172. For this purpose, of course, the bead is made of a diameter which exceeds the opening in the tapered end of the spring 161. By selecting the width of the broadest portion of the spring 161 to be just slightly smaller than the width of the insert lateral movement of the spring in the insert is minimized. Lateral movement of the corona discharge portion of the coronodes 50 is also substantially minimized by selecting the width of the slots 149 and 171 and passageways 174, and also the corresponding slots and passageways on the opposite end block assembly to be sufficiently narrow to restrict movement of the coronodes 50. The compression springs 172 counteract any "creep" or stretching of the coronodes and, unlike tension springs, they cannot be overstretched during assembly or use.

The coronodes 50 used in the device of this invention may be made of any conductive wire material of appropriate diameter. However, the mounting structure of this invention is of particular advantage when used with a dielectric coated coronode of the type described in copending application Ser. No. 748,805 (continuation of Ser. No. 595,656) in the joint names of T. Davis and G. Safford filed Dec. 7, 1976, and assigned to the assignee of this application. Briefly, the coronode disclosed in the above noted application comprises a thin wire 152 coated with a glass or dielectric sleeve 153, FIG. 5. In corona discharge arrangements using such a coronode a problem arises in preventing the fracture or breaking of the outer dielectric sleeve during assembly and use of the corona device.

Using such a coronode in the support structure of this invention the dielectric or glass sleeve 153 is first stripped away adjacent the ends of the coronode and the conductive beads are attached to the bare wire. The compression springs are then threaded through one end of each coronode in a manner shown in FIG. 4 and this end of the coronode with its attached spring is inserted into the cavity 146. The sleeve or dielectric coating is concurrently placed in the passageway 174. The opposite end of the coronode is grasped and put under tension so that the beads 72 may be inserted over the slot 48 while concurrently placing the other end of the glass or dielectric sleeve in the passageway 74. It will be noted that, the passageways 74 and 174 provide a base or support on which the ends of the dielectric coating rest, while a tension or bias is applied to the wire coronode by the spring 161 operating on the interior wire only. This latter feature helps prevent breakage or splitting of the outer sleeve during use of the corona device. The threaded end of the terminal 51 is then threaded into the top in the insert 47.

Assembly of the end block is then completed by attaching the upper half-sections 61 and 91 to the lower half-section by means of the attaching screws.

Figure 5:
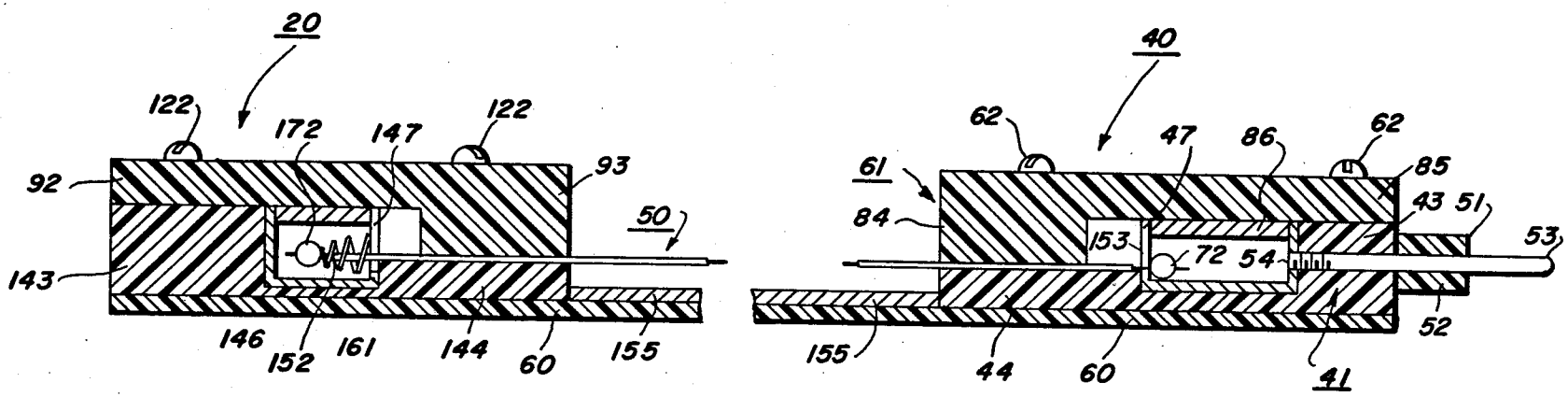
FIG. 5 is a side view partly broken away of the mounting structure of the invention.

For controlling the deposition of charge by the corona device of the invention there may be provided a biased or grounded conductive plate or shield 155, FIG. 5. This shield 155 may be attached to the connecting plate 60 by any suitable means such as an adhesive or by screws or the like or may be fitted into a slot or channel in the member 60 of the type generally similar to that shown in U.S. Pat. No. 3,908,127.

The specific embodiment has been described as including a planar support member 60 but it is equally possible to utilize a support member which is generally U-shaped in cross-section with the end block assembly supported by any suitable means at opposed ends of the channel.

While the invention has been described in connection with a specific examplary embodiment thereof, it will be understood that many modifications will be readily apparent to those of ordinary skill in the art; and that this application is intended to cover any adaptations or variations thereof.

For example, the support member 60 may be formed as a unit with either or both of the sections 41 and 121 with the support 60 being U-shaped or some other suitable shape known in the art. Any well known method of forming the plastic units integrally may be used for this purpose.

In addition, instead of using screws to fasten the various sections together, biased or resilient clips or flanges which cooperate with suitable recesses may be provided on the parts to be joined.

In view of the diversity of modifications possible, it is intended that this invention by only limited by the claims and the equivalents thereof.

What is claimed is:

1. A corona generating device including a coronode supported between a pair of end block assemblies, said coronode including enlarged conductive beads adjacent both ends, said end block assemblies each comprising mating part sections, each assembly including a cavity and a conductive insert lining at least a part of said cavity, one of said beads in direct contact with a first of said inserts and the other bead in electrical contact with said other insert via a resilient spring means carried by said coronode.

2. The combination recited in claim 1 wherein said part cases include upper and lower sections, said cavities being located in said lower sections.

3. The combination recited in claim 1 wherein said coronode comprises a wire coated with a dielectric sleeve, said beads are carried by said wire, further including conduits defined by each of said assemblies and formed jointly by said part sections, said sleeve resting adjacent the ends thereof directly on the floor of said conduits.

4. The combination recited in claim 1 wherein said assembly is held a fixed distance apart by an insulating support and a conductive plate spans said distance intermediate said blocks.

5. A corona generating device comprising a coronode supported between insulating end block assemblies, the assemblies formed by mating part cases which jointly define an at least partly conductor lined cavity and a conduit from exterior said assembly to said cavity, the ends of said coronode having enlarged conductive masses associated therewith, said coronode having areas adjacent both ends thereof passing through said conduits with said masses located in said cavities.

6. The combination recited in claim 5 wherein said coronode includes an inner wire and an outer dielectric sleeve, said sleeve resting on the floors of said conduits and said masses located on opposed ends of said wire.

7. The combination recited in claim 6 further including a resilient means carried on one end of said wire for applying a tension force to said wire.

8. The combination recited in claim 7 wherein said resilient means is a compression spring coaxially carried by said coronode, opposite ends of said spring bearing respectively against one of said conductors and one of said masses.

9. The combination recited in claim 8 wherein said spring is tapered with the larger diameter end thereof bearing against said conductor and the smaller diameter end thereof bearing said mass.

10. The combination recited in claim 5 wherein portions of said conductor lining are carried on each part case.

11. The combination recited in claim 5 wherein one of said part cases includes a boss and the other a recess, said boss interfitting into said recess to facilitate alignment of said assembly.

12. A corona discharge device including an elongated coronode, enlarged masses carried by opposed ends of said coronode, insulating end block assemblies for supporting opposed ends of said coronode, said assemblies including cavities and conductive inserts lining at least a part of said cavities, said masses located within said inserts, and a spring carried on one end of said coronode adjacent a first of said masses for biasing said first mass in a direction outward of said device and for concurrently biasing the other of said masses remote from said spring into contact with its associated insert.

13. The combination recited in claim 12 wherein said spring is a compression spring and is located to bear concurrently against an interior wall of one of said inserts and said first mass.

14. The combination recited in claim 12 wherein said coronode comprises an inner wire having an outer dielectric sleeve.

15. The combination recited in claim 14 wherein said masses are carried by opposed ends of said wire.

16. The combination recited in claim 15 wherein said assemblies are held a fixed distance from each other by an insulating support member to which each assembly is attached and further including a conductive plate carried by said support member intermediate said end blocks.

17. The combination recited in claim 12 wherein said assemblies are formed of mating part sections, said part sections jointly defining a conduit through which said coronode extends on its path into said cavities.

18. The combination recited in claim 14 wherein said coronode comprises a wire coated with an insulating sleeve, said masses are carried on opposed ends of said wire, said assemblies further including mating part sections which jointly form a conduit leading from the exterior of said assemblies into said cavities, said sleeve resting on the floors of said conduits.

19. A corona discharge device comprising a coronode and a pair of insulating end blocks, each end block comprising a pair of part sections, the part sections having formations which interfit with each other to form a conduit and a cavity, a conductive insert fitted into each cavity, said coronode supported intermediate said end blocks, the opposed end portions of said coronode having enlarged masses carried thereon, said coronode passing into said blocks through said conduits and terminating within said inserts.

20. The combination recited in claim 19 wherein said coronode comprises a wire covered with an insulating sleeve, said masses are attached to opposed ends of said wire, and further including a tapered compression spring coaxially carried adjacent one end of said coronode and associated with a first of said masses and a first insert, said spring located within one of said inserts intermediate an interior wall of said first insert to bias said first mass in a direction outward of the device along the longitudinal axis of the coronode and to concurrently bias the other of said masses into abutment with said second insert.

21. The combination recited in claim 20 further including a conductor in contact with said second insert and extending outside said block for coupling a high voltage to said second insert.

22. An insulating coronode support structure comprising a pair of insulating end blocks, each block formed by mating part sections, each block including a cavity jointly formed by said sections and conductor means lining at least a part of said cavity, coronode conduits leading from exterior said blocks into said cavities, and means for fastening said part sections together.

23. The combination recited in claim 22 wherein said conduits are formed jointly by said part sections.

24. The combination recited in claim 23 wherein said conductor means is carried in part on each of said sections.

25. The combination recited in claim 24 wherein each said conductor means includes slots aligned with said conduits.

26. A corona discharge device having a plurality of coronodes, a pair of insulating assemblies for supporting said coronodes, a first of said assemblies including a first open volume conductive insert and a first cavity lined in part by said insert, the second of said assemblies having a plurality of second open volume conductive inserts and a plurality of second cavities lined in part by said inserts, each said coronodes terminating within said first insert on one end thereof and within said second inserts on the other end thereof.

27. The combination recited in claim 26 wherein said assemblies are comprised of part sections which jointly define conduits through which said coronodes pass into said inserts, said inserts having slots aligned with said conduits.

28. The combination recited in claim 26 wherein said assemblies are comprised of part sections which mate with each other.

29. The combination recited in claim 26 wherein said first assembly includes a terminal extending from without said assembly into contact with said first insert for coupling a high voltage corona generating potential to said first insert.

30. The combination recited in claim 29 wherein each of said coronodes includes a wire having enlarged masses on opposed ends thereof, and resilient means operating on said masses associated with said second inserts to bias them outwardly of the device along the axis of said coronodes while concurrently biasing the masses associated with said first insert into contact therewith.

31. The combination recited in claim 30 wherein said masses are located within said inserts and said resilient means comprises a plurality of compression springs carried by the ends of said coronodes in said second inserts.

32. The combination recited in claim 26 wherein said coronodes are terminated with enlarged conductive masses, said masses being located within said inserts.

* * * * *